United States Patent [19]

Chevallier

[11] 4,249,573

[45] Feb. 10, 1981

[54] PROGRAMMED-SEQUENCE FLUID DISTRIBUTOR FOR USE IN FEED AND MAINTENANCE OF DETERGENT CONCENTRATION IN THE WASHING BATH OF A DISH-WASHING MACHINE OR THE LIKE

[75] Inventor: Rene G. Chevallier, Annemasse, France

[73] Assignee: Odev S.A., Geneva, Switzerland

[21] Appl. No.: 943,763

[22] Filed: Sep. 20, 1978

[30] Foreign Application Priority Data

Sep. 21, 1977 [CH] Switzerland ..... 11581/77

[51] Int. Cl.[3] ..... B08B 3/00

[52] U.S. Cl. ..... 137/624.2; 307/141.4; 307/141.8; 134/57 D; 134/58 D

[58] Field of Search ..... 307/141, 139, 140, 141.4, 307/141.8; 134/58 D, 57 D, 58 R; 137/624.2, 624.11; 417/12; 222/70

[56] References Cited

U.S. PATENT DOCUMENTS

| | | | |
|---|---|---|---|
| 2,859,760 | 11/1958 | Borell | 134/57 D X |
| 3,639,844 | 2/1972 | Karklys | 134/57 D |

*Primary Examiner*—Alan Cohan

*Attorney, Agent, or Firm*—Larson, Taylor and Hinds

[57] ABSTRACT

A programmed sequence fluid distributor system is provided which is particularly adapted for controlling fluid feeding and the maintenance of the detergent concentration in the washing bath of a dish-washing machine or the like. The system basically comprises a fluid source, a conduit arrangement for moving the fluid to a desired location, a pump for controlling the flow of the fluid and a programmer for controlling the pump. The programmer comprises an electronic circuit including at least two stages. These stages each comprise RC type oscillators wherein the resistive branch includes a potentiometer for setting the duration of the cycle associated with that stage. A binary pulse counter counts the pulses produced by the oscillator and ultimately controls the stopping and starting of the pump during the various operating cycles of the machine, by controlling energization of a relay in the pump circuit.

8 Claims, 3 Drawing Figures

CI1
CI2
CI3
CI4
OS1
OS2
OS3
OS4
RT
P
RL
F8
F9
CF
CD
I
V1a V5
t1
t2
T
R14
PR
p1
p2

PROGRAMMED-SEQUENCE FLUID DISTRIBUTOR FOR USE IN FEED AND MAINTENANCE OF DETERGENT CONCENTRATION IN THE WASHING BATH OF A DISH-WASHING MACHINE OR THE LIKE

FIELD OF THE INVENTION

The present invention relates to a programmed-sequence fluid distributor which is particularly adapted for the feed and maintenance of the detergent concentration in the washing bath of a dish-washing machine or the like.

BACKGROUND OF THE INVENTION

As described in more detail below, prior art washing machines characteristically include dish rack baskets which are carried on a moving belt, the baskets first being transported beneath a washing spray and then under a rinsing spray. The baskets moved along a path above a trough that contains the washing bath, which is generally heated and thereafter suctioned to the washing spray station. The washing bath liquid suctioned by the washing spray falls back into the bath after contacting the dishes, and the rinse water falls likewise into the bath. An overflow arrangement keeps the bath in the trough at a constant maximum level. The detergent concentration in the bath will, of course, diminish because of dilution caused by the addition of rinse water falling into the trough. To re-establish this concentration to its initial value (and thereby ensure washing which is of uniform effectiveness), extra detergent must be added at regular intervals. In the past this has been done empirically by hand or by primitive means that involve constraints and disadvantages which do not, for example, permit addition of detergent following the evaluation of the viscosity or the pH of the bath nor rigorous sustaining of the detergent concentration in the bath, and which consequently do provide uniform washing effectiveness.

SUMMARY OF THE INVENTION

As applied to machines of the type discussed above, the according to the invention provides automatic operation and thus frees the user and the process from the above-mentioned constraints and drawbacks.

Generally speaking, the distributor of the invention comprises a fluid source; a conduit system for transporting the fluid to a receiver or to an evacuation zone; fluid movement control means, (preferrably a pump) for, according to the program cycles, causing or preventing this transporting of fluid, and a sequential programming device which, depending upon the cycle, commands the starting or the stopping of the fluid movement control means.

The distributor of the invention is characterized in that the programmer is constituted by an electronic circuit which comprises at least two stages, each stage being composed of an RC type oscillator-binary pulse generator wherein the resistor branch includes a potentiometer that regulates the output frequency of the oscillator so that the duration of a cycle (and actuation or de-actuation of the fluid movement control means) is precisely determined. Each stage also includes a binary pulse counter that acts as a frequency divider, serving to count the pulses received from the oscillator. The output of counter switches state or level after the counting by the counter of a fixed number of the oscillator pulses, the counting period having a duration which is equal to that of the cycle. The switching of the counter output of a first stage counter causes blocking of the oscillator of this first stage and also causes the oscillator of the second stage to operate during the second cycle. At the end of the second cycle, this second stage oscillator, after the counting of the pulses produced thereby by the counter of the second stage, is blocked by switching the output of the latter counter. This electronic circuit further comprises a power stage and a relay that commands the starting or the stopping of the fluid movement of control means for the duration of a cycle. The power stage, which commands energizing of the relay, sustains or does not sustain the excitation of the coil of said relay according to input to the power stage that is provided during the cycle by binary logic curcuit held at the same level (high or low) by the output of the counter which is active throughout this cycle. The distributor provides that, at least when the electronic circuit is energized, the counters of the various stages will be set to zero by actuation of a flip-flop circuit included in the electronic circuit.

When the distributor is used in the feed and maintenance of the detergent concentration in the washing bath of a dish washer or the like, the electronic circuit, which constitutes the programmer of the distributor, comprises four stages connected in cascade. The first stage is triggered or tripped when the machine is started, and the duration of a first cycle is set by the potentiometer of the oscillator of this first stage so as to maintain the flow of detergent that constitutes the fluid during this first cycle and the feed of the machine trough with detergent by actuation of said fluid movement control means (pump). The second stage, which is triggered by the stopping of the operation of the first stage, controls the duration of a second cycle as determined by the setting of the potentiometer of the oscillator of the second stage. During this cycle, filling the trough with clear water is completed and the second stage cuts off flow of detergent by blocking the fluid movement control means. The third stage, which triggered by the stopping of the operation of the second stage, controls the duration of the third cycle as determined by the setting of the potentiometer of the oscillator of this third stage. During this third stage the washing of the dishes is effected together with the sucking off the bath contained in the trough and the effecting of rinsing. The latter involves a diluting addition of rinse water in the bath as explained above, the bath being kept at a maximum volume by the action of an overflow. This third stage continues to prevent the flow of detergent by blocking the fluid movement control means. The fourth stage, which triggered by the stopping of the operation of the third controls the duration of a fourth cycle regulated by the potentiometer of the oscillator of this fourth stage. During this stage the rinsing is ended and this last stage once again maintains the flow of detergent so that a supplementary amount, intended to restore the bath concentration to its initial value, is emptied into the trough by actuation of said fluid movement control means. Termination of the operation of the fourth stage causes a new triggering of the third stage, which beings the indefinite repetition of the third and fourth cycles, caused by successive repetitive actuation of the third and fourth stages, until the machine is stopped at the end of successive multiple washings and rinsings.

It should be noted that the fluid movement control means may be other than a pump, and, for example, may be a simple intake valve where the fluid is delivered by gravity. Moreover, as explained in more detail below, the distributor can also be utilized for automatic filling of receptacles, feed of pulverizers during during special periods, precise metering of solutions, or other analogous applications.

Other features and advantages of the invention will be set forth in, or apparent from, in detailed description of preferred embodiments found hereinbelow.

DESCRIPTION OF THE PREFERRED EMBODIMENTS

Figure 1:
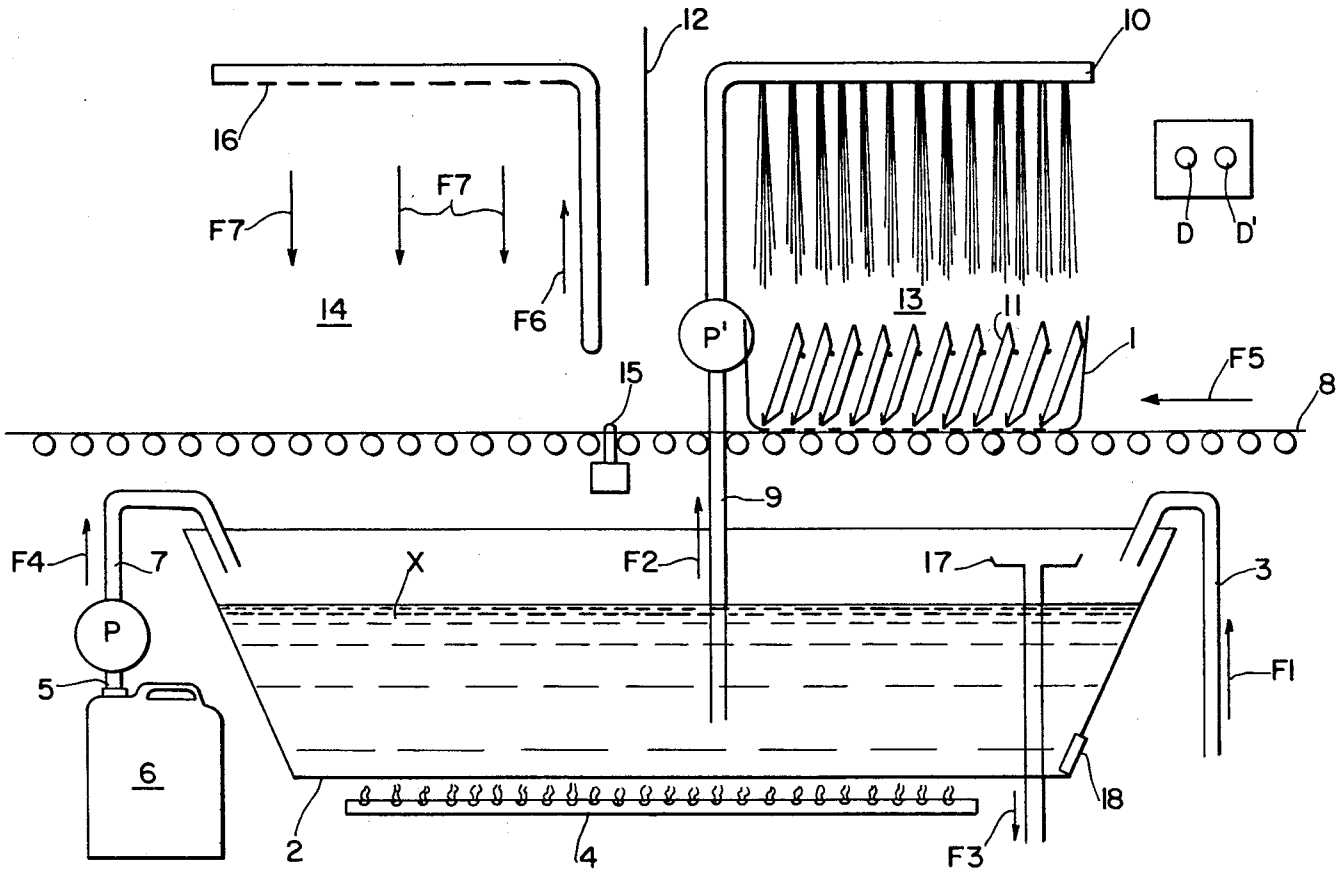
FIG. 1 a schematic representation of a dish washer machine incorporating a distributor according to the invention.

Referring first to FIG. 1, a dish washing machine incorporating the distributor of the invention is shown. The dish washing machine comprises a trough 2 for holding washing bath X, including clear water brought in, in the direction of arrow F1, by a conduit 3, and detergent brought in, in the direction of arrow F4, by a conduit 7. This movement of the fluids is controlled by the action of pump P of the distributor, which pump extracts the detergent from a reservoir 6 through a conduit or plunger 5. The dishes that are to be washed are indicated at 11 and are presented in successive carrier baskets, such as 1, disposed on a moving rack or conveyor belt 8 which moves the baskets in the direction of arrow F5. Baskets 1 are moved successively through a washing zone 13 and a rinsing zone 14, with these two zones being advantageously separated by a rubber flap 12. When trough 2 is filled and bath X is heated by a row of gas burners 4 or the like, a further pump P' sucks bath X via a conduit or plunger 9, in the direction of arrow F2, to a washing spray 10 which sprays dishes 11 as carrier basket 1 passes therethrough. The liquid thus sprayed on dishes 11 falls back into rough 2.

When passing from washing zone 13, basket 1 causes actuation of a pressure contact 15 or the like so as to provide the delivery of rinse water, in the direction of arrow F6, to a rinsing spray 16. Sprayer 16 sprays the washed dishes 11 in the direction of arrows F7 and thus rinses them. The rinse water falls into trough 2 thus diluting bath X. The maximum volume of bath X is kept uniform by an overflow arrangement 17 which provides for outflow of surplus liquid from the fall of rinse water into trough 2, in the direction of arrow F3. A drainage outlet 18 or the like allows emptying of trough 2 at the end of use of the washing machine.

The times provided for washing, e.g. one minute, and rinsing, e.g. thirty seconds, are regulated by the machine. Starting the operation of this machine, to wit, the feeding of trough 2 with clear water via conduit 3 and the heating of this water by gas jets 4 is effected by pressing a button D. Depending upon the type of machine, the subsequent start-up of belt 8 and the triggering of the washing are accomplished automatically after the initial depression of button D, when the filling of trough 2 and the heating of the water has been completed or, at the appropriate moment, by depressing a second button D'. It is also possible to synchronize this triggering of the washing and the start of the moving belt with the distributor program. Of course, it is possible to add to the detergent contained in reservoir 6 any other desirable product such as a disinfectant, a dessicant or the like.

Figure 2:
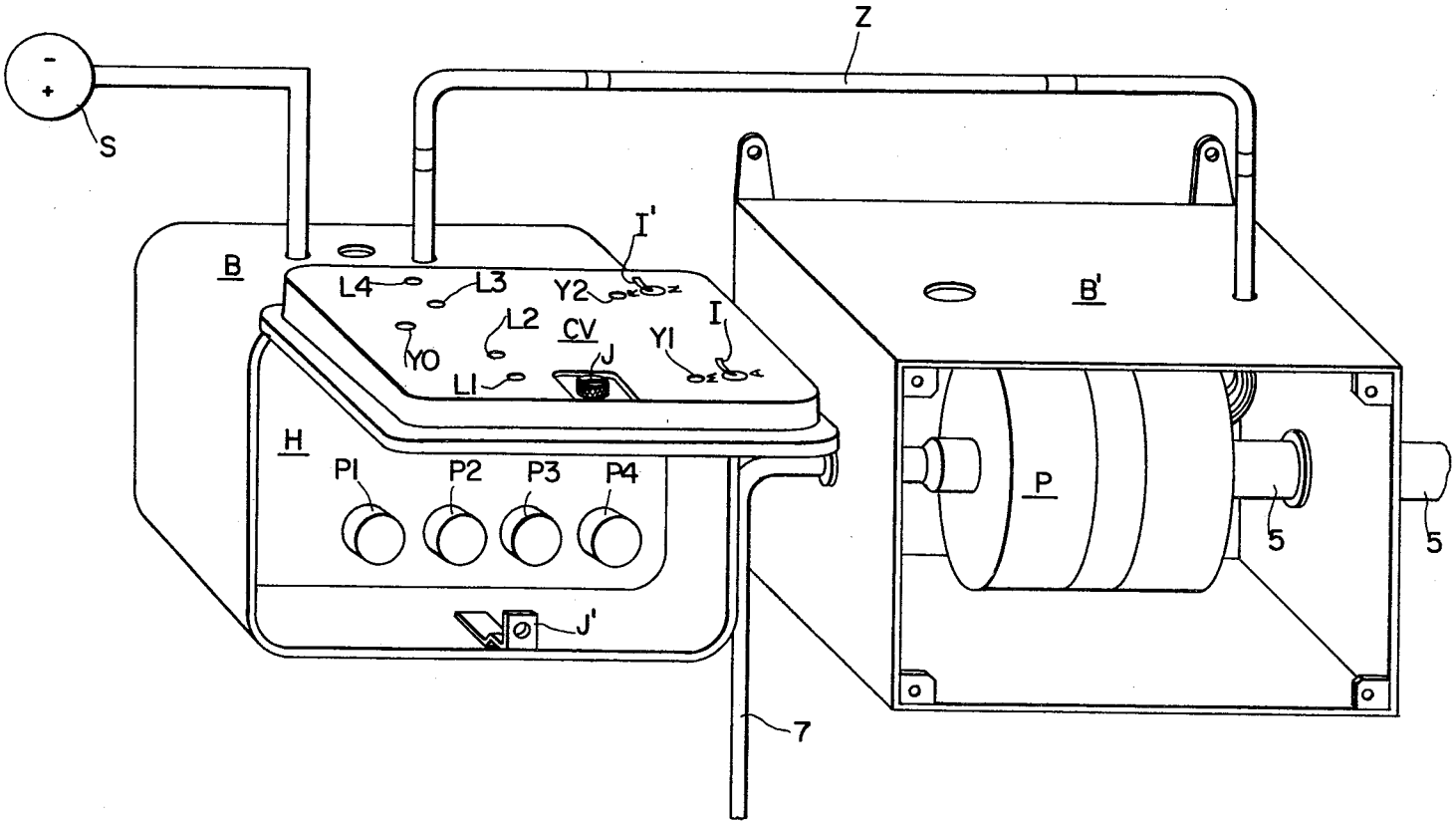
FIG. 2 is a perspective view of the distributor of the invention.

Referring now to FIG. 2, a distributor according to the invention is shown. The distributor acts independently of the machine and hence does not entail an modification of the machine, or any adaptation for actuation of the distributor as clearly shown in FIG. 1. The distributor comprises two boxes or housings B and B' connected by a cable Z for supplying electrical power to pump P. Pump P is enclosed in the second box B' and the latter is fixed on the wall. Pump P is disposed between the conduit or plunger 5 for extracting detergent from reservoir 6 and the conduit 7 for transporting the detergent to trough 2. The first box B is supplied by a source S and includes a cover CV which can be bent down and tightened by fastening means J, J'. Box B includes switches I and I', the former having an energizing position (M) and stopping position (A) for controlling the programmer of the distributor, and the latter enabling selection of the cycle regime. The cycle regimes comprise CN (normal for four cycles and indefinite repetitions of the last two) and R (direct programmer starting regime with indefinite repetition of the third and fourth cycles). Signal lights Y1 and Y2 are associated with the switches I and I' while a further signal light Yo indicates that there is a connection between box B and source S. Box B also includes light emitting diodes L1, L2, L3 and L4 which "blink" during the first (I), second (II), third (III) and fourth (IV) cycles, respectively. Located inside box B is a programmer whose four potentiometers P1, P2, P3 and P4 which provide for adjustment or regulation of the durations of the cycles I, II, III and IV respectively, and which are fixed on a plate H which is suitably marked to provide an indication of the setting. When potentiometers P1 to P4 have been adjusted, closing and fastening of cover CV presents access to the inside of box B to avoid accidental maladjustment.

Figure 3:
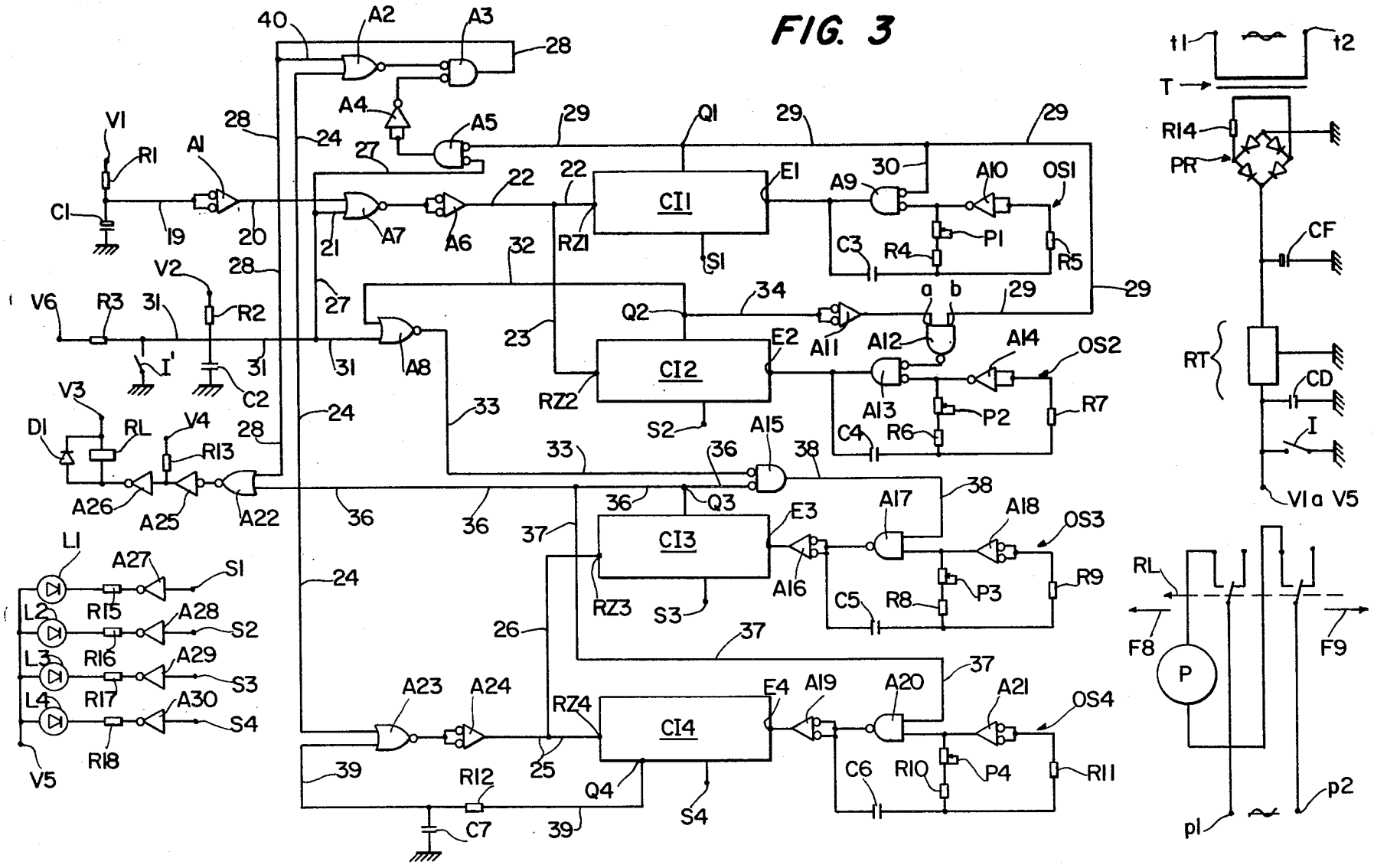
FIG. 3 is a circuit diagram of the distributor programming circuit.

Referring to FIG. 3, the distributor programmer of the invention as illustrated. In describing FIG. 3, the operation of the distributor will be considered from start of the machine.

Cycles I to IV of the distributor are programmed by adjusting the settings of potentiometers P1 to P4. The operator then closes cover CV, connects box B to electrical supply S, switches switch I' to position N in which switch I' is closed (FIG. 3) thereby grounding an input line 31, and switches switch I into position M in which switch I is open, and at the same time depresses button D whose command output is advantageously pair with that of switch I. Signal lights Yo and Y1 light up, and light Y2 is extinguished (illumination of light Y2 indicating the direct start-up mode with repetitive cycles III and IV).

In the exemplary embodiment under consideration, the duration of each washing is intended to be one minute, and that of each rinsing (including the time necessary for basket 1 to pass from washing zone 13 to rinsing zone 14) is to be thirty seconds, the duration of the initial feed of trough 2 with detergent is to be one minute, the feed of trough 2 with clear water and the heating of bath X is to be three minutes and the flow of supplementary detergent introduced in trough 2 to restore the concentration of bath X is to be two seconds. Thus, assuming that the programmer starts simultaneously with the start-up of the machine the initial feed of trough 2 with detergent takes place at the same time as the feed of said trough 2 with clear water. The durations of cycles I, II, III and IV, as fixed by adjustment of the settings of potentiometers P1, P2, P3 and P4, respectively, are designated T1, T2, T3 and T4, respectively, with T1=duration of the detergent feed to trough 2=60 seconds; T2=duration of filling of trough 2 with clear water and the heating of the bath X minus duration of the initial feed of detergent to trough 2=3 minutes−T1=120 seconds; T3=duration of a washing and rinsing minus the duration (T4) of T3=duration of a washing and rinsing minus the duration (T4) of the flow of supplementary detergent introduced in trough 2 to restore the concentration X=90 seconds−2 seconds=88 seconds; and T4=duration of the flow into trough 2 of this detergent supplement=2 seconds.

Depression of button D triggers the filling of trough 2 with clear water through conduit 3 and heating this water by lighting the row of gas jets 4 (see FIG. 1). The voltage supplied by source S is applied to terminals t1 and t2 of a transformer T shown in the upper right hand corner of FIG. 3 and which forms part of a power supply circuit, as well as to terminals p1 and p2 of the electric exciter circuit of the motor of pump P shown in the lower right-hand corner. This latter circuit remains open so long as the contacts of a relay RL are not moved in the direction of arrow F8. The secondary transformer T is connected through a resistor R14 to a rectifier bridge PR, including an associated filter capacitor CF and voltage regulator RT with output capacitor CD. On opening of switch I, the power supply circuit provides a direct voltage=Vcc at points, V1, V2, V3, V4 and V5. Since the electronic circuit of the programmer shown in FIG. 3 is a binary circuit, the "high" and "low" levels to which reference is made in the following description correspond, respectively, to the voltage +Vcc and zero voltage (0). Cycle I thus simultaneously begins the feeding of trough 2 with clear water, the heating of this water, and application of voltage +Vcc at points V1, V2, V3, V4 and V5.

The application of the voltage +Vcc at point B1 causes gradual charging of a capacitor C1 and RC circuit R1/C1 via a line 19, an inverter circuit A1 and a line 20. This voltage also causes the initial appearance of a positive phase pulse which triggers the resetting to zero of a first binary pulse counter CI1 (at input RZ1) and a second binary pulse counter CI2 (at input RZ2) by means of a NOR circuit A7 and an inverter circuit A6, via lines 22 and 23. This pulse also causes resetting to zero of binary pulse counter CI3 (at input RZ3) and a fourth binary pulse counter CI4 (at RZ4) via line 24 of a NOR circuit A23 and an inverter circuit A24 via lines 25 and 26. Binary counters CI1, CI2, CI3 and CI4 are respectively connected to four oscillators comprising binary pulse generators OS1, OS2, OS3 and OS4 and count the output pulses thereof. Counters CI1 to CI4 act as frequency dividers, and constitute with pulse generators OS1 to OS4, the four stages of the programmer identified as OS1/CI1, OS2/CI2, OS3/CI3 and OS4/CI4. These stages are connected in cascade and respectively energized during successive cycles I, II, III and IV.

The initial impulse referred to above provides energization of the circuit shown in FIG. 3, so as to start with a predetermined voltage level. The pulse is also applied via a line 24 to the lower input of a NOR circuit A2. Initially of positive phase, this pulse is inverted by NOR circuit A2 and (as low level pulse) is applied to the upper input of an AND circuit A3 with inverted inputs, whose lower input is also at the low level as will be shown subsequently. The output of circuit A3 then goes to the high level, i.e., goes "high", and is simultaneously applied via lines 28 and 40, respectively, to the inputs of the pair of NOR circuits A22 and A2. This confirms the high level applied to the lower input of circuit A2 allowing storage in the memory of the initializing pulse circuits A2 and A3 acting as a flip-flop. This arrangement also provides stable maintenance via line 28 of the high level applied to the upper input of circuit A22 whose output is thus at the high level.

Resistor R13 to which voltage +Vcc is applied at point V4 performs the role of polarizing the input of a phase inverter circuit A26 which is used as a power stage to allow excitation of the coil of relay RL and serves as an "open drain". Inverter circuit-power stage A26, whose input is put at the high level by the output of an inverter A25, ensures the lower level at the output thereof thereby allowing excitation of the coil of relay RL with the +Vcc voltage, applied thereto at input terminal V3. A light emitting diode D1 eliminates inverse voltages due to currents produced by the inductance of the relay coil. The contacts of relay RL are then pulled in or closed, in the direction of arrow F8 which closes the exciter circuit of the motor of pump P shown in the lower right-hand corner of FIG. 3. Pump P, starting at the beginning of cycle I, will initially feed trough 2 with detergent during period T1, extracting the detergent from reservoir 6 (see FIG. 1).

The output terminal Q1 of binary pulse counter CI1, being reset to zero, is at the low level and this output is applied via a line 29 to the upper input of an AND circuit A5 having inverted inputs, and via this line 29 and a line 30 to the upper input of an AND circuit A9 having inverted inputs. The output signal at Q1 of counter CI1 is also applied, via line 29, to input b of a NAND circuit A12. Since the lower input of AND circuit A5 is grounded via lines 31 and 77 by the closing of switch I', this input of AND circuit is at the low level, i.e., is "low" (like the inputs of NOR circuits A7 and A8). Since the two inputs of circuit A5 are at the low level, the output of circuit A5 is at the high level. This output is applied to the input of inverter circuit A4 whose output is thus at the low level, this output being, of course, applied to the lower input of circuit A3, as previously stated. Since the upper input of circuit A9 is in the low level as indicated above, and its lower input is also in the low level before the triggering of oscillator OS1, the output of circuit A9 is at the high level and oscillator OS1 is energized from the beginning of cycle I. The upper input of AND circuit A9 merely serves the role of triggering or interrupting the operation of oscillator OS1.

Oscillators OS1, OS2, OS3 and OS4 are RC type oscillators comprising two inverter circuits A9/A10, A13/A14, A17/A18, A20/A21, respectively, and fixed capacitors C3, C4, C5 and C6, respectively. The resistor branch of the oscillators is constituted by a parallel arrangement of a fixed resistor R5, R7, R9 and R11, respectively, and a variable resistor constituted by the series arrangement of a fixed resistor R4, R6, R8 and R10, respectively, and an adjustable resistor constituted by the active part of potentiometer P1, P2, P3 and P4, with phase inversions provided by inverter circuits A10, A14, A18 and A21. The RC circuits regulate the respective output frequencies of the oscillator in question. Binary counters CI1, Ci2, CI3 and CI4 serve to provide an acceptable RC time constant which does not require an excessively high value for capacitors C3, C4, C5 and C6, and to enable precise adjustment by potentiometers P1, P2, P3 and P4 of the high frequency output of oscillators OS1, OS2, OS3 and OS4. As noted above, counters CI1 to CI4 operate as frequency dividers at the outputs of the respective oscillators. Once energized, stages OS1/CI1, OS2/CI2, OS3/CL3, OS4/CI4 function similarly, the oscillator frequency of each being adjusted by adjusting the setting of the associated potentiometer which of course, determines the duration of operation of pump P or time at which pump P is stopped or deactuated, according to the program cycle in question.

The train of pulses produced by oscillator OS1 is applied to the counting input E1 of binary pulse counter CI1. Output S1 of counter CI1 is designed to pass to the high level, i.e., go "high" with every $2^3=8$ pulses. When the counter output is high diode L1 is caused to "blink", by means of the connection to power stage A27 and current-limiting resistor R15 (see the lower left-hand portion of FIG. 1). This occurs during the period T1 of cycle I. The output Q1 of binary pulse counter CI1 is designed to pass to the high level, i.e., go high, after counter CI1 has counted $2^{11}=2048$ pulses emitted by oscillator OS1. At this time, the oscillator OS1 is blocked by virtue of the application of this high level to the upper input of circuit A9 via lines 29 and 30. In addition, this high level is applied to the upper input of AND circuit A5 via line 29, and the output of AND circuit A5 goes to the low level so as to provide storage of the initial pulse. This low level output is applied via circuits A4 and A3 and line 28 to the upper input of NOR circuit A22 whose output goes high and as the input of inverter circuit A25 is inverted. The resultant low level output of inverter A25 is applied to the input of the inverter-power stage circuit A26, whose output goes high, causing the voltage at the terminals of the coil of relay RL to drop. The relay RL is de-energized and the relay contacts open, in the direction of arrow F9, and thus de-energize the exciter circuit of the motor of pump P. Pump P thus stops, thereby interrupting the flow of detergent into trough 2 at the end of period T1. Binary pulse counter CI1 counts 2048 pulses during the period T1. Since the duration of each of these pulses is in inverse proportion to the frequency of oscillator OS1, as adjusted by potentiometer P1, the latter precisely controls the duration of the period T1, as indicated hereinabove. It is obvious that the situation is the same for the three other potentiometers P2, P3 and P4 with respect to times T2, T3 and T4.

It is to be understood that for a given flow from pump P and a desired concentration of bath X, the duration T1 of cycle I depends upon the capacity of trough 2, and that as a function of this capacity, suitable tables can be supplied to the user of the machine, to allow the operator appropriately to adjust potentiometer P1, (as well as potentiometer P4), e.g., to a period of one minute. Such a a duration is typical for a trough having a capacity of 100 liters, and for a detergent concentration in bath X of 0.5%.

Trough 2, which is no longer fed with detergent from the beginning of cycle II, continues to receive clear water during period T2 of cycle II. Potentiometer P2 regulates this time T2, as part of oscillator OS2, during which time the detergent flow is interrupted by the action of the second stage of the program as just explained.

At the end of cycle I, the change of the output Q1 of binary pulse counter CI1 to the high level causes the switching of input b of NAND circuit A12, via line 20, from low to high. Following the initial resetting to zero of binary pulse counter CI2, its output Q2 is in the low level which is applied via line 34 to the input of inverter circuit AI1 whose output is thus put into the high level. This output is applied, via line 35, to the other input a of said NAND circuit A12 whose output is thus placed at the low level in accordance with the operating principles of a NAND circuit. This low level is applied to the upper input of the AND circuit A13 which has inverted inputs and whose lower input is also at the low level before the triggering of oscillator OS2. Thus, the output of AND circuit A13 is put into the high level, which allows the startup of oscillator OS2. The train of pulses produced by oscillator OS2 is applied to the counting input E2 of binary pulse counter CI2. Since the output S2 of counter CI2 is likewise adjusted to change to the high level with every $2^3=8$ pulses, this causes light emitting diode L2 to flash or blink, via power stage A28 and current limiter resistor R16, throughout the period T2 of cycle II. The output Q2 of binary pulse counter CI2 id designed to pass to the high level after the counter has counted $2^{12}=4096$ pulses produced by oscillator OS2. This high level causes oscillator OS2 to stop, the high level signal being applied via line 34 to the input of inverter circuit A11 whose resultant low level output is applied via line 35 to input a of NAND circuit A12. The output of NAND circuit A12 is a high level signal applied to the upper input of AND circuit A13 and thus causes blocking of oscillator OS2 at the completion of period T2 of cycle II.

During this period, relay RL is kept inoperative and pump P is stopped. Maintaining relay RL inoperative during period T2 of cycle II has the effect that, throughout period T2, inputs of the NOR circuit A22 are "low", this maintains the high level at the output of the inverter power stage circuit A26. This occurs following the switching of output Q1 of binary pulse counter CI1 to the high level at the conclusion of cycle I which, via line 29, AND circuit A5, inverter A4, circuit A3 and line 28, causes and then sustains the low level appearing at the upper input of NOR circuit 22 and following the initial resetting of binary pulse counter CI3 to zero. So long as output Q3 of pulse counter CI3 has not switched to the high level (an event which occurs only at the end of cycle III) this low level will also be maintained at the lower input of NOR circuit A22, via line 36. This arrangement serves to render relay RL inoperative throughout the period T3 of cycle III. This operation will not be described again in the subsequent description of the processes of cycle III.

During cycle II, trough 2 is filled with clear water that is heated by gas jets 4. Passage to the high level of the output Q2 of binary pulse counter CI2 at the end of cycle II causes the high level signal to be applied via line 32 to the upper input of NOR circuit A8. The lower input of NOR circuit A8 is held in the low level via line 31 by the closing of switch I' which grounds this lower input. The input of NOR circuit A8 is thus placed on the low level which is applied via line 33 to the upper input of an AND circuit A15 having inverted inputs. The output Q3 of binary pulse counter CI3 is in the low level following initial resetting to zero of this counter, this low level being transmitted via line 36 to the lower input of said circuit A15 whose output is thus held at the high level. This high level is applied via line 38 to the upper input of NAND circuit A17 whose output causes oscillator OS3 to start and to apply the pulses produced thereby to input E3 of binary pulse counter CI3, via an inverter circuit A16 which reestablishes the necessary phase for this binary pulse counter CI3. Cycle III begins.

As has already been stated, the advance of conveyor belt 8 and the initiation of the washing phase by actuation of pump P' which sucks the liquid of bath X to washing spray 10 (FIG. 1) are triggered, either automatically, e.g., by a delay system in the machine following the initial depression of button D by the operator, or by pressure on button D' by the operator at the start of cycle III, or by possible synchronizing of this triggering operation with the actuation of the cycle III by the programmer, depending upon the type of machine. When the washing operation is finished, basket 1 leaves washing zone 13 and moves into rinsing zone 14, thereupon acting on contact 15 so as to cause delivery of rinse water to rinsing spray 16. Spray 16 sprays dishes 11 in said basket 1 to provide rinsing. The rinse water falls into trough 2 where it dilutes bath X whose maximum volume is kept constant by an overflow 17, as discussed previously.

Referring to FIG. 3, the train of pulses produced by oscillator OS3 is applied to the counting input E3 of binary pulse counter CI3. The output S3 of counter CI3 is also adjusted to switch to the high level with every $2^3=8$ pulses. This causes light emitting diode L3 to blink throughout T3 of cycle III, by virtue of the connection from power stage A29 and current limiting resistor R17. During period T3, pump P is inoperative and the flow of detergent is interrupted because relay RL is inoperative for the reason already explained with reference to cycle II (the inputs of NOR circuit A22 are not the low level). The output Q3 of the binary pulse counter CI3 is adjusted to go "high" after counter CI3 has counted $2^{11}=2048$ pulses produced by oscillator OS3, corresponding to the passage of period T3 of cycle III. This switching of the output Q3 to the high level stops oscillator OS3 by application of this high level via line 36 to the lower input of AND circuit A15 whose output goes to the low level, this output being applied via line 38 to the upper input of the NAND circuit A17 thereby blocking oscillator OS3, and terminating cycle III. Binary pulse counter CI3 stops counting at this point. Simultaneously, the high level is applied by output Q3 via line 36 to the lower input of NOR circuit A22 whose upper input has remained at the lower level applied thereto via line 28 from the output of AND circuit A3. After this, the output of NOR circuit 22 switches to the low level, which low level is applied via circuits A25 and A26 to the lower end of the exciter coil of relay RL which again causes movement of the relay contacts in the direction of arrow F8 and completes the energizing circuit of pump P.

Completion of the energizing circuit initiates the time period T4 of cycle IV, during which pump P again feeds trough 2 with detergent with the purpose of restoring bath X to its original detergent concentration, the bath X having been depleted because of the addition of rinse water as explained above. During cycle IV, oscillator OS4 is actuated. In this regard, at the termination of cycle III, the high level of output Q3 of binary pulse counter CI3 is further applied via line 37 to the upper input of NAND circuit A20 whose output causes energization of oscillator OS4. Oscillator OS4 applies a train of pulses to input E4 of binary pulse counter CI4 via inverter circuit A19 which restores the necessary phase to binary pulse counter CI4. Cycle IV begins and, throughout time T4, the rinsing phase is carried out.

Output Q4 of binary pulse counter CI4 is also adjusted to switch to the high level with every $2^3=8$ pulses, which causes diode 14 to flash or blink throughout the period T4 of cycle IV by virtue of the connection through power stage A30 and current limiting resistor R18. Binary pulse counter CI4 counts the pulses received from oscillator OS4, with the coil of relay RL remaining in a state of excitation. The output Q4 of binary pulse counter CI4 is adjusted to pass to the high level after the counter has counted $2^9=512$ pulses. This pulse duration is equal to the period T4 of cycle IV. Thus cycle IV is then completed, the high level being applied by output Q4 via line 39, resistor R12 and capacitor C7 to the lower input of NOR circuit A23 which, by means of inverter A24 via lines 25 and 26, resets the two binary pulse counters CI3 (at input RZ3) and CI4 (at input RZ4) to zero, thereby having the effect of restoring output Q4 of binary pulse counter CI4 to the low level. In this regard, the role of resistor R12 and capacitor C7, which determine the RC time constant, is to ensure a slight delay in transmission of the high level at output Q4 to the lower input of the NOR circuit A23. In this way, the resetting to zero of binary pulse counter CI4, which causes switching of the output Q4 to the low level, is effected reliably, without risk of oscillation. Simultaneously, the resetting to zero of binary pulse counter CI3 forces output Q3 of the latter to switch to the low level. This low level appears at the lower input of NOR circuit A22 via line 36. The NOR circuit A22, in cooperation with circuits A25 and A26, makes it possible to interrupt the excitation of the coil of relay RC at the completion of cycle IV. Thus, by rendering relay RL inoperative, so that the relay contacts are moved in the direction of arrow F9, the energizing circuit for the motor of pump 9 is opened. Pump 9 stops at the end of this cycle IV during which the extra detergent is supplied to trough 2. Thus, at the end of cycle IV, the rinse phase is completed and bath X has had the initial concentration of detergent restored. Moreover, at this time, the washing machine is ready to wash the dishes contained in the second basket (not illustrated) which is disposed a predetermined distance from basket 1 and is introduced, in turn, into zone 13 when the first basket 1 leaves rinsing zone 14.

We will now consider, under the conditions now to be described, the successive indefinite repetition of cycles III and IV whose total duration (T3+T4) corresponds to that of the washing and then the rinsing of the dishes in a basket. As discussed above, this repetition is effected automatically until the machine is stopped and switch I is put into the stop position (A) (see FIG. 2), switch I, when closed (see FIG. 3), grounding points VI to V5.

Referring to FIG. 3, the low level applied at the end of cycle IV via line 36 to the lower input of AND circuit A15, following the resetting to zero of binary pulse counter CI3, immediately imposes the high level at the output of AND circuit A15. This occurs because the upper input of AND circuit A15 is also at the low level as applied thereto via line 33 by NOR circuit A8 after the switching to the high level of output Q2 of binary pulse counter CI2 at the end of cycle II, this high level being applied via line 32 to the upper input of circuit A8. The high level at the output of AND circuit A15 is applied via line 38 to the upper input of NOR circuit A17. Thus, conditions for starting or energization of oscillator OS3 are met, and the third stage functions for a new cycle III during which detergent feed to trough 2 remains interrupted because pump P is held inoperative. The end of this new cycle III causes blocking of oscillator OS3, because of the switching of output Q3 of binary pulse counter CI3 to the high level. The excitation coil of relay RL is again energized and a new cycle IV is begun during which additional detergent is again delivered to trough 2 as described previously. Thus cycles III and IV are automatically and indefinitely repeated until the distributor is stopped, and the machine is also stopped at the end of the rinsing of the dishes in the last basket. Trough 2 is then emptied by opening drainage opening 18.

According to an important feature of the invention, the distributor enables repetition of cycles I and II to be avoided by putting the machine back into operation after a momentary interruption which does not require emptying of trough 2. In this regard, the operator need only to place switch I' into the repeat position (R), which causes illumination of light Y2 (FIG. 2) and opening of this switch I' (see FIG. 3) before the restarting of the machine directly in the washing phase and the placing of switch I into the operating position (M) of the programmer (see FIG. 2). It is, of course, advantageous to provide synchronization of this restarting of the machine from the opening of switch I' of the programmer.

Under these conditions, switch I' being open, line 31 is no longer grounded. Application of voltage +Vcc at point V2 of timing circuit R2/C2 causes the charging of capacitor C2. The charge on capacitor C2, as applied via line 31, causes the lower input of OR circuit A8 go high and, applied via lines 27 and 21, simultaneously causes the lower input of NOR circuit A7 to go high. As a result, the output of NOR circuit A8 goes to the low level which level is applied, via line 33, to the upper input of AND circuit A15 whose output goes high. This high level is applied via line 38 to the input of circuit A17 which triggers the start of oscillator OS3. A second result is that the output of NOR circuit A7 goes to the low level and this level, which applied to the input of inverter circuit A6, similtaneously causes, via lines 22 and 23 the resetting to zero, at inputs of RZ1 and RZ2, respectively, of the binary pulse counters CI1 and CI2. The outputs Q1 and Q2 of counters CI1 and CI2 are maintained from that time in the low level and hence block or prohibit operation of oscillators OS1 and OS2. Thus, the distributor, starting with the opening of switch I', provides for elimination of cycles I and II and for directly starting with cycle III followed by cycle IV, repeating cycles III and IV indefinitely until the distributor and the machine are stopped.

It is noted that application by remote control of a direct voltage at point V6, with switch I' open, allows charging across resistor R3 of capacitor C2 to provide direct starting of the programmer in repetitive cycles III and IV.

In a specific embodiment, the characteristics of the main components of the programmer circuit shown in FIG. 3 are as follows:

R1, R2, R4, R8, R10 and R13=10 kΩ/0.25 watt resistors;
R3=resistor whose value depends upon the remote control characteristics associated therewith;
R12=3.9 Ω/0.25 watt resistor;
R15, R16, R17 and R18=1.5 kΩ/0.25 watt resistors;
P1, P2, P3 and P4=potentiometers, 1 MΩ;
C1=15 microfarad/20 volt tantalum capacitor;
C2 and C7 100 nanofarad/250 volt polyester capacitors;
C3 to C6=220 nfd/63 v metallized polycarbonate capacitors;
CF=470 mfd/40 vcc electrolytic filtering capacitor;
CD−10 nfd/4− volt paper or polyester capacitor;
L, L2, L3 and L4=10 mA light emitting diodes;

It will be clear from the foregoing discussions that cycles II and III are timing cycles with respect to the flow of detergent. Consequently, for applications of the distributor of the invention which are simpler than that just described, e.g., for the precise filling of a series of successive receptacles or bottles with a specific quantity of fluid, it is sufficient that the programmer of the distributor comprise at least two stages, one of which allows maintenance of the flow of the fluid into each of the said receptacles or bottles during the filling thereof, and the other of which provides the duration of the time period during which the receptacle or bottle which follows in sequence is moved into the filling position when the flow interrupted. In certain dispensing applications, it is even possible to assign to each of the stages the role of sustaining the successive flow into the same receptacle or bottle of a first fluid in a quantity regulated by one of the stages and of a second fluid in a quantity regulated by the other stage. With this arrangement separate reservoirs for providing the supply of fluid to the distributor, which acts as a dispenser, will be actuated to release the fluid therein, in turn, by action of the pump P.

Although it is theoretically possible to use the distributor with only one stage in the programmer, this use would not provide sequential programming and the distributor, thus reduced to the role of adjustable flow supply, would advantageously be replaced by less complicated devices so that this possible application of the distributor is of little or no economic interest.

As to use of the distributor for the feeding and maintenance of detergent concentration in the bath of a dish washing machine, the distribution will, of course, be adapted depending on the type of machine on which the distributor is used, to adjust the periods T1, T2 and T4, e.g. by the use of the tables already mentioned. This process would take into account the capacity of the trough, the quantity of detergent necessary to obtain the desired concentration in bath X and the quantity necessary to keep this concentration uniform at the end of each rinsing. The period T3, of course, depends only upon the durations of the washing and rinsing.

It will also be understood that the uses of the distributor can be extended to addition of other produces into trough 2 such as disinfectants, dessicants and the like, as already mentioned above.

Finally, regarding other possible uses of the distributor of the invention, aside from uses for controlling the flow of liquids (the filling of receptacles or bottles, accurate dispensing of several liquids into the same receptacle or bottle, and the like), the distributor has application in controlling the flow of gaseous fluids or aerosols (automatically programmed deodorizing of garbage chutes, programmed ventilation of rooms and the like) by addition of a nozzle at the end of the fluid flow conduit at its outlet from the distributor.

Although the invention has been described relative to exemplary embodiments thereof, it will be understood that other variations and modifications can be effected in these embodiments without departing from the scope and spirit of the invention.

I claim:

1. A programmed sequence fluid distributor comprising a fluid source, a conduit system for moving said fluid to a desired location, fluid movement control means for controlling the movement of the fluid in dependence upon a programmed sequence and a sequential programming means for, in dependence upon the programmed sequence, controlling the actuation and de-actuation of the said fluid movement control means, said sequential programming means comprising an electronic circuit comprising at least two stages, each said stage comprising a binary pulse generating RC oscillator including a resistor branch having a potentiometer therein for regulating the oscillation frequency of the said oscillator and for setting the duration of a cycle, said cycle being completed when the said fluid movement control means is actuated or de-actuated, and a binary pulse counter connected to said oscillator for counting the pulses received from said oscillator and for producing a predetermined output when the counter counts a fixed number of said pulses, the duration of said counting by said counter being equal to the duration of the cycle, and the predetermined output of the counter of the first stage causing blocking of the oscillator of said first stage and initiating the operation of the oscillator of the second stage during the second cycle, said oscillator of the second stage, at the end of said second cycle and after the counting of the pulses produced thereby by the counter of said second stage, being blocked by the switching of the output of said second stage counter; said electronic circuit further comprising a power stage and a relay for commanding the actuation or de-actuation of the said fluid movement control means during a said cycle, said power stage controlling energization of said relay so as to maintain or not maintain the excitation of the coil of said relay according to the input to said power stage during the cycle, said electronic circuit including binary logic circuit for controlling the input to said power stage responsive to the output of the counter of the stage that is actuated during the said cycle; said electronic circuit further comprising a flip-flop circuit for providing resetting to zero of the counters of the different stages.

2. A distributor as claimed in claim 1, wherein the distributor is used for the feeding and maintenance of detergent concentration of the washing bath of a dish washing machine or the like including a trough to which fluid is fed and which contains a bath, and wherein said electronic circuit of said distributor comprises four stages connected in cascade, the first stage triggering the start-up of the machine for the duration of a first cycle as determined by the setting of the potentiometer of the oscillator of said first stage, during which cycle said first stage maintains the flow of detergent constituting said fluid and the feed of the trough of the machine with detergent, by actuation of said fluid movement control means; the second stage being triggered by the termination of operation of the first stage for the duration of a second cycle as determined by the setting of the potentiometer of the oscillator of said second stage, during which cycle the trough is filled with clear water, said second stage preventing flow of detergent by causing de-actuation said fluid movement control means; the third stage being triggered, by the termination of operation of the second stage, for the duration of a third cycle as determined by the setting of the potentiometer of the oscillator of said third stage, during which cycle the machine effects washing by suction of the bath contained in the trough and then carries out rinsing which entails a diluting delivery of rinse water to said bath, said bath being held at a maximum constant volume by the action of an overflow and said third stage acting to prevent flow of detergent by deactuation of said flow movement control means; said fourth stage being triggered, by the termination of operation of the third stage, for the duration of a fourth cycle determined by the setting of the potentiometer of the oscillator of said fourth stage during which cycle, with termination of the rinsing, said fourth stage maintains the flow of detergent again, so that a supplementary quantity for restoring the concentration of bath to its original value is emptied into the trough by actuation of said fluid movement control means, the termination of operation of the fourth stage then causing a new triggering of the third stage which begins the indefinite repetition of the third and fourth cycles by successive and repetitive starting of the third and fourth stages, until the stopping of the machine at the end of multiple successive washings and rinsings.

3. A distributor as claimed in claim 1, wherein the programming means comprises a four-stage programmer and the oscillator of each of the stages of comprises two phase inverter circuits, the first being constituted by a binary inverter connected in the resistor branch of the oscillator between the fixed resistor of said branch and a variable resistor comprising the potentiometer for setting the duration of the cycle controlled by the associated said stage, the second stage comprising a binary NAND circuit associated with a inverter circuit and connected between said resistor branch and the fixed capacitor of the oscillator, said second stage inverter circuit triggering the start of the cycle so as to maintain the oscillator operative during the course of the cycle and then causing the operation of the oscillator to terminate, said oscillator applying a train of pulses during the course of the cycle to the input of the binary pulse counter associated with the oscillator.

4. A distributor as claimed in claim 1, wherein the programming means comprises a four-stage programmer and the oscillator of each of the stages of comprises two phase inverter circuits, the first being constituted by a binary inverter connected in the resistor branch of the oscillator between the fixed resistor of said branch and a variable resistor comprising the potentiometer for setting the duration of the cycle controlled by the associated said stage, the second stage comprising a binary NAND circuit associated with an inverter circuit and connected between said resistor branch and the fixed capacitor of the oscillator, said second stage inverter circuit triggering the start of the cycle so as to maintain the oscillator operative during the course of the cycle and then causing the operation of the oscillator to terminate, said oscillator applying the train of pulses during the course of the cycle to the input of the binary pulse counter associated with the oscillator.

5. A distributor as claimed in claims 3 or 4, wherein the four stages of the programmer are successively actuated in the course of four consecutive cycles and wherein the output of the binary pulse counter of the last stage is connected to the binary pulse counters of the last two stages by means of a timer constituted by a resistor and a capacitor and a NOR circuit followed by an inverter circuit so as to cause said stages to be reset to zero when the output of said binary pulse counter of said last stage changes state at the end of the cycle assigned to the said fourth stage, thereby providing successive and indefinite repetition of the third and fourth cycles.

6. A distributor as claimed in claim 5, wherein upon energization of the programmer, the two first cycles are eliminated and the programmer passes directly into the third cycle by opening of a switch which energizes a circuit that, by means of a NOR circuit and an inverter, transmits a zero-reset pulse to the binary pulse counters of the first two stages which blocks the said first two stages.

7. A distributor as claimed in claim 5, wherein each of the binary pulse counters provides an intermittently varying output which causes the blinking of a signalling light emitting diode through means of a power stage and a current limiting resistor throughout the cycle assigned to the stage of the respective binary pulse counter.

8. A distributor as claimed in claim 2, wherein means are provided for, following a momentary interruption of the operation of the machine, starting the programming means of said distributor directly in the third cycle, by indefinite repetition of the third and fourth cycles, with the first and second cycles being bypassed.

* * * * *